US008962086B2

(12) United States Patent
Roussel et al.

(10) Patent No.: US 8,962,086 B2
(45) Date of Patent: Feb. 24, 2015

(54) PROCESS FOR COATING A SURFACE OF A SUBSTRATE MADE OF NONMETALLIC MATERIAL WITH A METAL LAYER

(75) Inventors: Sebastien Roussel, Soisy sur Seine (FR); Frida Gilbert, Dourdan (FR)

(73) Assignee: Pegastech, Orsay (FR)

( * ) Notice: Subject to any disclaimer, the term of this patent is extended or adjusted under 35 U.S.C. 154(b) by 943 days.

(21) Appl. No.: 13/089,740

(22) Filed: Apr. 19, 2011

(65) Prior Publication Data

US 2011/0256413 A1 Oct. 20, 2011

Related U.S. Application Data

(60) Provisional application No. 61/282,906, filed on Apr. 19, 2010.

(30) Foreign Application Priority Data

Apr. 19, 2010 (FR) ..... 10 01663

(51) Int. Cl.

| | |
|---|---|
| ***B05D 3/10*** | (2006.01) |
| ***C23C 18/16*** | (2006.01) |
| ***C23C 18/20*** | (2006.01) |
| ***C23C 18/22*** | (2006.01) |
| ***C23C 18/38*** | (2006.01) |
| ***C25D 5/56*** | (2006.01) |

(52) U.S. Cl.

CPC ..... *C23C 18/1658* (2013.01); *C23C 18/1653* (2013.01); *C23C 18/2013* (2013.01); *C23C 18/2073* (2013.01); *C23C 18/22* (2013.01); *C23C 18/38* (2013.01); *C25D 5/56* (2013.01)

USPC ..... 427/299; 205/167; 427/305; 427/307

(58) Field of Classification Search

USPC ..... 427/299, 307, 305; 205/167

See application file for complete search history.

(56) References Cited

U.S. PATENT DOCUMENTS

| | | | | |
|---|---|---|---|---|
| 3,553,085 | A * | 1/1971 | Heymann | 205/167 |
| 3,598,630 | A | 8/1971 | Doty et al. | |
| 4,701,351 | A | 10/1987 | Jackson | |
| 4,981,715 | A | 1/1991 | Hirsch et al. | |
| 5,160,600 | A * | 11/1992 | Patel et al. | 205/169 |
| 5,395,651 | A * | 3/1995 | Sodervall et al. | 427/304 |
| 2004/0023080 | A1 * | 2/2004 | Buhay et al. | 428/702 |
| 2004/0086728 | A1 * | 5/2004 | Maruoka et al. | 428/447 |

FOREIGN PATENT DOCUMENTS

| | | |
|---|---|---|
| CN | A-1641070 | 7/2005 |
| CN | A-101054663 | 10/2007 |
| CN | A-101381865 | 3/2009 |
| WO | WO 02/36853 A1 | 5/2002 |

OTHER PUBLICATIONS

Nagao et al., "Challenge to Chromium-free Plastic Plating Method," *Galvanotechnik*, pp. 2124-2130 (with English-language).

French Search Report in French Patent Application No. 1001663; dated Nov. 11, 2010 (with English-language translation).

Gao et al, Study on Colloidal Activation Solution of Nonmetal Electroplating, Surface Technology, vol. 22, No. 2, 1993, pp. 63-65, 69 (with English Translation).

Zhongzi et al, Study on the Process of Copper Autocatalytic Plating of Plastics, Journal of Materials Engineering, No. 6, 1989, pp. 32-34 (with English Translation).

* cited by examiner

*Primary Examiner* — Nathan T Leong
(74) *Attorney, Agent, or Firm* — Oliff PLC

(57) ABSTRACT

A process for coating a surface of a substrate made of nonmetallic material with a metal layer consisting of providing a substrate made of nonmetallic material; subjecting a surface of said substrate to a treatment for increasing the specific surface area thereof; subjecting the resulting surface to an oxidizing treatment; contacting the resulting substrate with a solution containing an ion of a metal from groups IB and VIII of the Periodic Table; obtaining a substrate comprising ions of a metal that are chemically attached to the nonmetallic material constituting the substrate on at least one of its surfaces; subjecting the ions to a reducing treatment to obtain a substrate comprising atoms of a metal that are chemically attached to the nonmetallic material constituting the substrate on a part of at least one of its surfaces; and contacting the resulting surface with a solution containing ions of a metal.

20 Claims, No Drawings

PROCESS FOR COATING A SURFACE OF A SUBSTRATE MADE OF NONMETALLIC MATERIAL WITH A METAL LAYER

The present invention relates to a process for coating a surface of a substrate made of nonmetallic material with a metal layer in order to make it capable of being treated, by virtue of the strong adhesion of the coating, by conventional metallization processes such as electroplating.

Processes for metalizing materials consist in depositing a thin layer of metal on the surface of a substrate. The advantage of such processes is that they provide many functions: visual, decorative, conducting, reinforcing, etc. Metallization is widely used for parts employed in the following industries: aeronautics, automotive, cosmetic, household electrical appliances, bathroom installations, connectors, microelectronics, etc.

Many processes for metalizing nonmetallic substrates have been described in the literature and in patents.

Most of these metallization processes use the electroconducting or electrochemical potential properties of metal particles that have been deposited on the nonmetallic substrates during what is called an activation step. This activation step is also commonly preceded by a step of increasing the specific surface area in order for the substrate to be "rough" enough to allow good attachment of the metal particles.

The major drawback of these processes is in particular the use of hexavalent chromium during the step of etching the surface of the substrate or modifying the roughness thereof, this being a powerful oxidating agent that makes it possible to obtain a high roughness necessary for attachment of the metal particles but that is known for its high toxicity.

The step of activating the surface consists in depositing, on the surface of the nonmetallic material, and in maintaining thereon, metal particles or metal cations that will subsequently be reduced to form metal particles. This step requires the use of palladium/tin colloidal particles that react only on certain type of polymer and requires the use of large amounts of palladium.

The article by T. Nagao, et al. (Galvanotechnik, 2006, 97, 7, 2124-2130) for example reviews the techniques used for metalizing ABS substrates, which further comprise surface cleaning and conditioning steps, an etching step using hexavalent chromium solutions, a step of depositing a Pd/Sn colloid and then a step of autocatalytic depositing a metal, more particularly copper. This article also discusses the technique called "Direct Acid Copper Plating" or the CRP process, which does not include the autocatalytic metal deposition step but does require the addition of palladium in the etching bath and/or large quantities of the Pd/Sn colloid in the catalyzing bath.

To limit the use of etching solutions based on hexavalent chromium, in U.S. Pat. No. 3,598,630 the step of etching ABS panels is performed by a solution of potassium permanganate and phosphoric acid and the step of forming the Pd/Sn colloid is carried out by successively applying a tin chloride solution and then a palladium chloride solution. In the process described, the autocatalytic metal deposition step is a conventional copper deposition step.

To limit the use of palladium, alternatives solutions have been proposed, for example in patent application WO 02/36853, in which the conventional process for metalizing an ABS substrate is modified by replacing the Pd/Sn colloid with an Ag/Sn colloid, and then, after all the Sn ions have been removed, the autocatalytic metal deposition step is a nickel deposition step. After the etching step using conventional chromic solutions and rinsing, a treatment may be carried out on the etched surface using a solution of products capable of improving the adsorption, such as polyelectrolytes in the form of cationic polymers.

Apart from the substantial use of palladium, the cost and rarity of which pose a problem when this is not substituted with silver, in all the processes described above the activation step is an adsorption step in which a colloidal preparation is used or formed by the addition of stannous ions, which thereafter have to be completely eliminated in order to allow harmonious and uniform development of the metal layer during the autocatalytic metal deposition step.

Alternative processes not employing colloidal solutions during the activation step, and replacing the adsorption with chemical bonding of metal ions in the form of complexes or chelates, have been proposed.

For example, U.S. Pat. No. 4,981,715 and U.S. Pat. No. 4,701,351 describe a process for coating a substrate with a thin layer of a polymer, for example polyacrylic acid, capable of complexing a noble metal compound, comprising a step of covering the substrate with a polymer capable of chelating metal ions followed by a step of bringing the polymer into contact with metal particles. The substrate is then subjected to the autocatalytic metal deposition step. In the examples of implementation, the metal cations used are palladium cations, but the main drawback of this process is that it necessitates controlling the quality of an additional interface, namely that created between the substrate and the layer of polymer capable of chelating a metal ion. Solutions have been proposed for example for treatment by irradiation that also allows regioselective attachment of this layer of chelating polymer and thus the possibility of metalizing the substrate selectively.

This solution, although it obviates the use of colloids, does entail the formation of an additional layer, the cohesion of which with respect to the substrate or the strength of attachment thereof to the substrate has to be controlled to an industrial level, and an additional step in the manufacturing process. Furthermore, problems of compatibility between the constituent material of the substrate and the chelating polymer may also arise.

The present invention makes it possible to simplify the various steps of this process for coating nonmetallic materials and to make it more environmentally friendly and less expensive, by developing a simpler coating process that does not use toxic and polluting reactants, without however an additional step and an additional layer being added.

The present invention therefore relates to a process for coating a surface of a substrate made of nonmetallic material with a metal layer, consisting of the following steps:

a) a substrate made of nonmetallic material is provided;

b) at least part of at least one surface of said substrate is subjected to a physical or chemical treatment for increasing the specific surface area thereof;

c) that surface of said substrate which was treated in step b) is subjected to an oxidizing treatment;

d) that surface of said substrate which was treated in step c) is brought into contact with a solution containing at least one ion of at least one metal and its counterion, said metal being chosen from the group constituted of the metals of groups IB and VIII of the Periodic Table of the Elements;

e) a substrate comprising ions of at least one metal that are chemically attached to the nonmetallic material constituting the substrate on at least one part of at least one of its surfaces is obtained;

f) said ions of at least one metal that are attached to the nonmetallic material constituting the substrate on a surface of said substrate are subjected to a reducing treatment and a substrate comprising atoms of at least one metal that are attached to the nonmetallic material constituting the substrate on at least one part of at least one of its surfaces is obtained;

g) that surface comprising particles of at least one metal which was obtained in step f) is brought into contact with a solution containing ions of at least one metal;

h) a coating formed by a layer of at least one metal is obtained on the treated surface of said substrate, said steps being optionally followed or preceded by one or more rinsing steps.

Step g) is an autocatalytic deposition step, also designed as electroless.

The expression "chemically bonded ions and/or atoms" is understood to mean atoms or ions bonded by chelation and/or complexation by functions or groups for example carboxylic (—COOH), hydroxyl (—OH), alkoxyl (—OR), carbonyl (—C═O), percarbonic (—CO—O—OH), nitro (N═O) and amide (—CONH) to the surface of said material.

In step f), the atoms of at least one metal that are attached to the nonmetallic material constituting the substrate are attached by ligand-metal interactions.

In one embodiment, activation step d) is carried out by contact with a solution containing an ion of a single metal and its counterion.

In one embodiment, steps b) and c) are carried out as a single step b') and the treatment is an oxidizing treatment.

In one embodiment, the metal of step f) and the metal of the ions of step g) are identical.

In one embodiment, steps f) and g) are carried out as a single step f').

During the coating process, the surface of said substrate made of nonmetallic material must firstly be prepared so as to obtain good adhesion of the metal layer to the surface. The surface of the substrate is cleaned of all of its contaminants, simultaneously creating a keying relief for adhesion of the future coating during step b) of the process.

The surface of the substrate may be completely or partly treated using the masking techniques well known to those skilled in the art, such as the use of protective varnishes that are resistant to oxidation steps.

In one embodiment, step b) is implemented by a physical treatment.

The term "physical treatment" is understood to mean a treatment for eliminating the low-cohesion layers and for increasing the surface roughness.

In one embodiment, the physical treatment is chosen from the group of impact treatments.

In one embodiment, step b) or b') or c) is implemented by an oxidizing treatment.

The term "oxidizing treatment" is understood to mean any treatment for preparing the surface by increasing the roughness, and therefore the specific surface area, of the surface for step b) and creating functions capable of chelating and/or complexing metal cations for step c).

In one embodiment, the oxidizing treatment is chosen from the group of chemical oxidizing treatments.

In one embodiment, the oxidizing treatment is chosen from the group of electrochemical oxidizing treatments.

In one embodiment, the oxidizing treatment of step c) is chosen from the group of physical oxidizing treatments.

According to the present invention, the substrate may be a nanoparticle, a microparticle, a plug of cosmetic products, an electronic component, a door handle, a household domestic appliance, spectacles, a decoration object, an automobile body element, an aircraft fuselage or wing element, a flexible conductor, or a connector.

The term "nonmetallic material" is understood to mean any material belonging to the family of organic materials, the family of mineral materials and the family of composite materials. As nonlimiting examples, the following may be mentioned: wood, paper, board, ceramics, plastics, silicones, fabrics, glass.

In one embodiment, the organic material is chosen from plastics.

The term "metal layer" is understood to mean a thin layer, ranging from a few nanometers to several hundred microns in thickness, of a metal and/or of a metal oxide deposited on the surface of a substrate.

In one embodiment, the nonmetallic material is a polymer chosen from the group comprising one-dimensional and three-dimensional natural, artificial, synthetic, thermoplastic, thermosetting, thermostable, and elastomeric polymers.

In one embodiment, the nonmetallic material may furthermore include at least one element chosen from the group comprising fillers, plasticizers and additives.

In one embodiment, the fillers are mineral fillers chosen from the group comprising silica, talc, glass fibers and glass beads.

In one embodiment, the fillers are organic fillers chosen from the group comprising cereal flour and cellulose pulp.

The additives are used to improve a specific property of the nonmetallic material, such as its color, its crosslinking, its slip or its resistance to degradation, fire resistance and/or resistance to bacterial and/or fungal attack.

In one embodiment, the polymer is a thermoplastic (co) polymer chosen from the group comprising a polyolefin, a polyester, a polyether, a vinyl polymer, a vinylidene polymer, a styrene polymer, a (meth)acrylic polymer, a polyamide, a fluoropolymer, a cellulous polymer, a poly(arylene sulfone), a polysulfide, a poly(arylether)ketone, a polyamideimide, a poly(ether)imide, a polybenzimidazole, a poly(indene/coumarone), a poly(para-xylylene), by themselves, as a blend, as copolymers or as a combination.

The polyolefins may be chosen from the group comprising a polyethylene, a polypropylene, an ethylene/propylene copolymer, a polybutylene, a polymethylpentene, an ethylene/vinyl acetate copolymer, an ethylene/vinyl alcohol copolymer, an ethylene/methyl acrylate copolymer, by themselves, as a blend, as copolymers or as a combination.

The polyesters may be chosen from the group comprising a polyethyleneterephthalate, whether or not modified by glycol, a polybutyleneterephthalate, a polyactid, a polycarbonate, by themselves, as a blend, as copolymers or as a combination.

The polyethers may be chosen from the group comprising a polyoxymethylene, a polyoxyethylene, a polyoxypropylene, a polyphenylene ether, by themselves, as a blend, as copolymers or as a combination.

The vinyl polymers may be chosen from the group comprising an optionally chlorinated polyvinyl chloride, a polyvinyl alcohol, a polyvinyl acetate, a polyvinyl acetal, a polyvinyl formal, a polyvinyl fluoride, a poly(vinyl chloride/vinyl acetate), by themselves, as a blend, as copolymers or as a combination.

The vinylidene polymers may be chosen from the group comprising a polyvinylidene chloride, a polyvinylidene fluoride, by themselves, as a blend, as copolymers or as a combination.

The styrene polymers may be chosen from the group comprising a polystyrene, a poly(styrene/butadiene), a poly(acrylonitrile/butadiene/styrene), a poly(acrylonitrile/styrene), a poly(acrylonitrile/ethylene/propylene/styrene), a poly(acrylonitrile/styrene/acrylate), by themselves, as a blend, as copolymers or as a combination.

The (meth)acrylic polymers may be chosen from the group comprising a polyacrylonitrile, a polymethyl acrylate, a polymethyl methacrylate, by themselves, as a blend, as copolymers or as a combination.

The polyamides may be chosen from the group comprising a polycaprolactam, a polyhexamethylene adipamide, a polylauroamide, a polyether-block-amide, a poly(meta-xylylene adipamide), a poly(meta-phenylene isophthalamide), by themselves, as a blend, as copolymers or as a combination.

The fluoropolymers may be chosen from the group comprising a polytetrafluoroethylene, a polychlorotrifluoroethylene, a perfluorinated poly(ethylene/propylene), a polyvinylidene fluoride, by themselves, as a blend, as copolymers or as a combination.

The cellulose polymers may be chosen from the group comprising a cellulose acetate, a cellulose nitrate, a methylcellulose, a carboxymethylcellulose, an ethylmethylcellulose, by themselves, as a blend, as copolymers or as a combination.

The poly(arylene sulfone) polymers may be chosen from the group comprising a polysulfone, a polyethersulfone, a polyarylsulfone, by themselves, as a blend, as copolymers or as a combination.

The polysulfides may be polyphenylene sulfide.

The poly(aryletherketone) polymers may be chosen from the group comprising a polyetherketone, a polyetheretherketone, a polyetherketoneketone, by themselves, as a blend, as copolymers or as a combination.

In one embodiment, the polymer is a thermosetting (co) polymer chosen from the group comprising an aminoplast such as urea-formaldehyde, melamine-formaldehyde, melamine-formaldehyde/polyesters, by themselves, as copolymers, as a blend or as a combination, a polyurethane, an unsaturated polyester, a polysiloxane, a phenol-formaldehyde, epoxy, allyl or vinylester resin, an alkyd, a polyurea, a polyisocyanurate, a poly(bismaleimide), a polybenzimidazole, a polydicyclopentadiene, by themselves, as copolymers, as a blend or as a combination.

In one embodiment, the (co)polymer is chosen from the group comprising acrylonitrile-butadiene-styrene (ABS), acrylonitrile-butadiene-styrene/polycarbonate (ABS/PC), methyl-methacrylate acrylonitrile-butadiene-styrene (MABS), a polyamide (PA) such as a nylon, a polyamine, a polyacrylic acid, a polyaniline and polyethyleneterephthalate (PET).

In one embodiment, the metal of the metal ion used in step d) is chosen from copper, silver, nickel, platinum, palladium and cobalt ions.

In one embodiment, the metal of the metal ion used in step d) is chosen from the group constituted of copper and nickel.

In one embodiment, the metal of the metal ion used in step d) is copper.

In one embodiment, the metal of the metal ions used in step g) or f') is chosen from the elements of groups IB and VIII of the Periodic Table.

In one embodiment, the metal of the metal ion used in step g) or f') is chosen from copper, silver, gold, nickel, platinum, palladium, iron and cobalt ions.

In one embodiment, the metal of the metal ion used in step g) or f') is chosen from the group constituted of copper and nickel.

In one embodiment, the metal of the metal ion used in step g) or f') is copper.

In one embodiment, the metal of the metal ion used in step g) or f') is nickel.

According to the invention, the group of impact treatments comprises sandblasting, shot peening, micropeening and ablation by an abrasive plot.

The term "chemical oxidizing treatment" is understood to mean a treatment for oxidizing the surface of the substrate by attaching thereto and/or introducing there to oxygen-rich groups such as carboxylic (—COOH), hydroxyl (—OH), alkoxyl (—OR), carbonyl (—C═O), percarbonic (—CO—O—OH), nitro (N═O) and amide (—CONH) groups capable of chemically bonding metal cations, then metals reduced by chelation and/or complexation.

According to the invention, the chemical oxidizing treatment is chosen from the group comprising Fenton's reagent, alcoholic potassium hydroxide, a strong acid, sodium hydroxide, a strong oxidizing agent and ozone, by themselves or in combinations.

In one embodiment, the strong acid is chosen from the group comprising hydrochloric acid, sulfuric acid, nitric acid, perchloric acid, acetic acid, oxalic acid, phosphorous acid, phosphoric acid, hypophosphorous acid, by themselves or as a mixture.

In one embodiment, the strong oxidizing agent is chosen from the group comprising $KMnO_4$ and $KClO_3$, by themselves or as a mixture.

In one embodiment, the strong oxidizing agent is $KMnO_4$.

The oxidizing treatments are chosen according to the nature of the constituent materials of the substrates: illustrated by way of example in table 1 below are various chemical oxidizing treatments that can be applied when the substrate is made of ABS or ABS/PC.

TABLE 1

| Oxidizing agent | Acid, by itself or as a combination |
|---|---|
| $KMnO_4$ | $H_3PO_4$ |
| | $H_3PO_2$ |
| | $H_3PO_3$ |
| | $H_2SO_4$ |
| | $C_2H_2O_4$ |
| | $H_3PO_4 + C_2H_2O_4$ |
| | $H_3PO_2 + C_2H_2O_4$ |
| | $H_3PO_4 + H_2SO_4$ |
| | $H_3PO_2 + H_2SO_4$ |
| $HNO_3 + HCl$ | $HNO_3$ |
| | HCl |
| $CH_3COOH$ | $CH_3COOH$ |

Table 2 below illustrates various oxidizing treatments according to the nature of the substrate.

TABLE 2

| Types of substrate | Nature of the oxidizing treatments |
|---|---|
| PP | $KMnO_4 + H_3PO_4$ |
| ABS | $KMnO_4 + H_3PO_4$ |
| ABS PC | $KMnO_4 + H_3PO_4$ |
| PA | HCl + isopropanol |
| PPS | $HNO_3$ + NaOH |
| MABS | $KMnO_4 + H_3PO_4 + H_2SO_4$ |
| | $CH_3COOH$ |
| PC | $H_2SO_4 + HNO_3$ |
| | $H_2SO_4$ |
| | KOH |

In one embodiment, the strong-acid mass ratios are between 5 and 100%.

In one embodiment, they are between 50 and 95%.

In one embodiment, they are between 70 and 90%.

In one embodiment, the duration of the strong-acid treatment is between 20 seconds and 5 hours.

In one embodiment, it is between 30 seconds and 3 hours.

In one embodiment, it is between 30 seconds and 20 minutes.

In one embodiment, the duration of the treatment by Fenton's chemical reaction is between 5 minutes and 5 hours.

In one embodiment, it is between 10 minutes and 3 hours.

In one embodiment, it is between 15 minutes and 2 hours.

In one embodiment, it is about 25 minutes.

In one embodiment, for the alcoholic potassium hydroxide treatment, the potassium hydroxide is diluted in a solution containing, as solvent, an alcohol chosen from the group comprising methanol, ethanol and propanol.

In one embodiment, said potassium hydroxide is diluted in a solution containing ethanol as solvent.

In one embodiment, the potassium hydroxide concentration in the alcoholic solution is between 0.1M and 10M.

In one embodiment, it is between 0.5M and 5M.

In one embodiment, it is about 3.5M.

In one embodiment, the duration of the alcoholic potassium hydroxide treatment is between 5 minutes and 5 hours.

In one embodiment, it is between 1 minute and 3 hours.

In one embodiment, it is between 5 minutes and 1 hour.

In one embodiment, in the case of the sodium hydroxide treatment, the sodium hydroxide mass ratios are between 10 and 100%.

In one embodiment, they are between 15 and 70%.

In one embodiment, they are between 20 and 50%.

In one embodiment, for the treatment by a strong oxidizing agent, the solution of strong oxidizing agent is neutral, acidic or basic.

In one embodiment, the solution of strong oxidizing agent is acidic.

In one embodiment, the strong oxidizing agent is chosen from the group comprising $KMnO_4$ and $KClO_3$, by itself or as a mixture, in hydrochloric acid, in sulfuric acid, in nitric acid, in oxalic acid, in phosphoric acid, in hydrophosphorous acid or in phosphorous acid.

In one embodiment, the $KMnO_4$ or $KClO_3$ concentration is between 10 mM and 1M.

In one embodiment, it is between 0.1M and 0.5M.

In one embodiment, it is about 0.2M.

In one embodiment, the acid concentration is between 0.1M and 10M.

In one embodiment, it is between 0.5M and 5M.

In one embodiment, it is about 3.5M.

In one embodiment, the duration of the treatment by a strong oxidizing agent is between 1 minute and 3 hours.

In one embodiment, it is between 5 minutes and 1 hour.

In one embodiment, it is between 6 minutes and 30 minutes.

In one embodiment, it is about 15 minutes.

In one embodiment, the chemical oxidizing treatment is an electrochemical treatment.

According to the invention, the counterion of the at least one metal of step d) is chosen from the group comprising tetrafluoroborate, sulfate, bromide, fluoride, iodide, nitrate, phosphate and chloride ions.

In one embodiment, the solution of step d) containing at least one ion of at least one metal and its counterion is a basic solution.

In one embodiment, the basic solution has a pH of greater than 7.

In one embodiment, it has a pH between 9 and 11.

In one embodiment, it has a pH of about 10.

In one embodiment, the duration of the treatment of step d) is between 30 seconds and 2 hours.

In one embodiment, it is between 1 minute and 1 hour.

In one embodiment, it is about 15 minutes.

According to the invention, the reducing solution of the reducing treatment of step f) is basic.

In one embodiment, the reducing solution comprises a reducing agent chosen from the group comprising sodium borohydride, dimethylamine borane and hydrazine solutions.

In one embodiment, the reducing agent is a sodium borohydride solution.

In one embodiment, the sodium borohydride solution has a neutral or basic pH.

In one embodiment, the dimethylamine borane solution has a basic pH.

In one embodiment, the pH is basic, sodium hydroxide in solution is used as solvent.

In one embodiment, the sodium hydroxide concentration is between $10^{-4}$M and 5M.

In one embodiment, it is between 0.05M and 1M.

In one embodiment, it is about 0.1M.

In one embodiment, the reducing agent concentration in the reducing solution of step f) is between $10^{-4}$M and 5M.

In one embodiment, it is between 0.01M and 1M.

In one embodiment, it is about 0.3M.

In one embodiment, the reduction step is carried out at a temperature between 10° C. and 90° C.

In one embodiment, it is carried out at a temperature between 30° C. and 70° C.

In one embodiment, it is carried out at a temperature of about 50° C.

In one embodiment, the duration of the reduction step is between 30 seconds and 1 hour.

In one embodiment, it is between 1 minute and 30 minutes.

In one embodiment, it is between 2 minutes and 20 minutes.

In one embodiment, the solution of step f') comprises ions of the metal, an agent for complexing the ions of the metal, a reducing agent and a pH regulator.

In one embodiment, said solution of step f') is an aqueous solution.

In one embodiment, the solution of step f') is an electroless bath solution containing a metal cation chosen from: $Ag^+$, $Ag^{2+}$, $Ag^{3+}$, $Au^+$, $Au^{3+}$, $Co^{2+}$, $Cu^+$, $Cu^{2+}$, $Fe^{2+}$, $Ni^{2+}$, $Pd^+$ and $Pt^+$.

In one embodiment, the solution of step f') is an electroless bath solution containing a metal cation chosen from: $Co^{2+}$, $Cu^+$, $Cu^{2+}$, $Ni^{2+}$ and $Pt^+$.

In one embodiment, the solution of step g) containing ions of at least one metal is an aqueous solution.

In one embodiment, said solution of step g) is an electroless bath solution containing a metal cation chosen from: $Ag^+$, $Ag^{2+}$, $Ag^{3+}$, $Au^+$, $Au^{3+}$, $Co^{2+}$, $Cu^+$, $Cu^{2+}$, $Fe^{2+}$, $Ni^{2+}$, $Pd^+$ and $Pt^+$.

In one embodiment, the solution of step g) is an electroless bath solution containing a metal cation chosen from: $Co^{2+}$, $Cu^+$, $Cu^{2+}$, $Ni^{2+}$ and $Pt^+$.

In one embodiment, the solution of step g) is an electroless bath solution containing a metal cation chosen from: $Cu^{2+}$ and $Ni^{2+}$.

In one embodiment, the duration of step g) is between 1 minute and 1 hour.

According to the invention, prior to and between each step of the process, the surface of the substrate and/or the substrate are/is rinsed one or more times with at least one rinsing solution.

In one embodiment, the rinsing solutions are identical or different.

In one embodiment, the rinsing solution is chosen from the group comprising water, distilled water, deionized water or an aqueous solution containing a detergent.

In one embodiment, the detergent contained in an aqueous solution is chosen from the group comprising TDF4 and sodium hydroxide.

In one embodiment, the sodium hydroxide concentration is between 0.01M and 1M.

In one embodiment, the rinsing solution is stirred during contacting with the surface of the substrate and/or the substrate.

In one embodiment, the stirring is carried out using a stirrer, a recirculation pump, air or gas bubbling, an ultrasonic bath or a homogenizer.

In one embodiment, the duration of each rinsing step is between 1 second and 30 minutes.

In one embodiment, it is between 5 seconds and 20 minutes.

The contacting of the surface of the substrate and/or the substrate with the solutions of the various steps may be carried out by immersion in a bath or by spraying and/or splashing.

When this contacting operation is carried out by immersion in a bath, the homogenization of said bath is carried out using a stirrer, a recirculation pump, air or gas bubbling, an ultrasonic bath or a homogenizer.

The invention also relates to the substrate obtained by the process of the invention, in which the surface of said substrate made of nonmetallic material is coated with a metal layer.

The invention relates to a substrate made of nonmetallic material, at least one surface of which is coated with a metal activation layer constituted of atoms of a metal that are bonded, through metal-ligand interaction, directly to the constituent material of the substrate by carboxylic (—COOH), hydroxyl (—OH), alkoxyl (—OR), carbonyl (—C═O), percarbonic (—CO—O—OH), nitro (N═O) or amide (—CONH) groups, said activation layer being covered with a layer of an identical or different metal deposited by autocatalytic deposition.

In one embodiment, the invention relates to a substrate made of ABS, the surface of which is coated with an activation layer consisting of copper, the atoms of which are bonded, through metal-ligand interaction, to the constituent ABS of the substrate, said activation layer being covered with a copper layer deposited by autocatalytic deposition.

In one embodiment, the invention relates to a substrate made of ABS, the surface of which is coated with an activation layer consisting of nickel, the atoms of which are bonded, through metal-ligand interaction, to the constituent ABS of the substrate, said activation layer being covered with a copper layer deposited by autocatalytic deposition.

In one embodiment, the invention relates to a substrate made of ABS/PC, the surface of which is coated with an activation layer consisting of copper, the atoms of which are bonded, through metal-ligand interaction, to the constituent ABS/PC of the substrate, said activation layer being covered with a copper layer deposited by autocatalytic deposition.

In one embodiment, the invention relates to a substrate made of ABS/PC, the surface of which is coated with an activation layer consisting of nickel, the atoms of which are bonded, through metal-ligand interaction, to the constituent ABS/PC of the substrate, said activation layer being covered with a copper layer deposited by autocatalytic deposition.

In one embodiment, the invention relates to a substrate made of PA, the surface of which is coated with an activation layer consisting of copper, the atoms of which are bonded, through metal-ligand interaction, to the constituent PA of the substrate, said activation layer being covered with a copper layer deposited by autocatalytic deposition.

In one embodiment, the invention relates to a substrate made of PA, the surface of which is coated with an activation layer consisting of nickel, the atoms of which are bonded, through metal-ligand interaction, to the constituent PA of the substrate, said activation layer being covered with a copper layer deposited by autocatalytic deposition.

In one embodiment, the invention relates to a substrate made of PC, the surface of which is coated with an activation layer consisting of copper, the atoms of which are bonded, through metal-ligand interaction, to the constituent PC of the substrate, said activation layer being covered with a copper layer deposited by autocatalytic deposition.

In one embodiment, the invention relates to a substrate made of PC, the surface of which is coated with an activation layer consisting of nickel, the atoms of which are bonded, through metal-ligand interaction, to the constituent PC of the substrate, said activation layer being covered with a copper layer deposited by autocatalytic deposition.

In one embodiment, the invention relates to a substrate made of MABS, the surface of which is coated with an activation layer consisting of copper, the atoms of which are bonded, through metal-ligand interaction, to the constituent MABS of the substrate, said activation layer being covered with a copper layer deposited by autocatalytic deposition.

In one embodiment, the invention relates to a substrate made of MABS, the surface of which is coated with an activation layer consisting of nickel, the atoms of which are bonded, through metal-ligand interaction, to the constituent MABS of the substrate, said activation layer being covered with a copper layer deposited by autocatalytic deposition.

In one embodiment, the invention relates to a substrate made of PP, the surface of which is coated with an activation layer consisting of copper, the atoms of which are bonded, through metal-ligand interaction, to the constituent PP of the substrate, said activation layer being covered with a copper layer deposited by autocatalytic deposition.

In one embodiment, the invention relates to a substrate made of PP, the surface of which is coated with an activation layer consisting of nickel, the atoms of which are bonded, through metal-ligand interaction, to the constituent PP of the substrate, said activation layer being covered with a copper layer deposited by autocatalytic deposition.

In one embodiment, the invention relates to a substrate made of PPS, the surface of which is coated with an activation layer consisting of copper, the atoms of which are bonded, through metal-ligand interaction, to the constituent PPS of the substrate, said activation layer being covered with a copper layer deposited by autocatalytic deposition.

In one embodiment, the invention relates to a substrate made of PPS, the surface of which is coated with an activation layer consisting of nickel, the atoms of which are bonded, through metal-ligand interaction, to the constituent PPS of the substrate, said activation layer being covered with a copper layer deposited by autocatalytic deposition.

In one embodiment, the invention relates to a substrate made of ABS, the surface of which is coated with an activation layer consisting of copper, the atoms of which are bonded, through metal-ligand interaction, to the constituent ABS of the substrate, said activation layer being covered with a nickel layer deposited by autocatalytic deposition.

In one embodiment, the invention relates to a substrate made of ABS, the surface of which is coated with an activation layer consisting of nickel, the atoms of which are bonded, through metal-ligand interaction, to the constituent ABS of the substrate, said activation layer being covered with a nickel layer deposited by autocatalytic deposition.

In one embodiment, the invention relates to a substrate made of ABS/PC, the surface of which is coated with an activation layer consisting of copper, the atoms of which are bonded, through metal-ligand interaction, to the constituent ABS/PC of the substrate, said activation layer being covered with a nickel layer deposited by autocatalytic deposition.

In one embodiment, the invention relates to a substrate made of ABS/PC, the surface of which is coated with an activation layer consisting of nickel, the atoms of which are bonded, through metal-ligand interaction, to the constituent ABS/PC of the substrate, said activation layer being covered with a nickel layer deposited by autocatalytic deposition.

In one embodiment, the invention relates to a substrate made of PA, the surface of which is coated with an activation layer consisting of copper, the atoms of which are bonded, through metal-ligand interaction, to the constituent PA of the substrate, said activation layer being covered with a nickel layer deposited by autocatalytic deposition.

In one embodiment, the invention relates to a substrate made of PA, the surface of which is coated with an activation layer consisting of nickel, the atoms of which are bonded, through metal-ligand interaction, to the constituent PA of the substrate, said activation layer being covered with a nickel layer deposited by autocatalytic deposition.

In one embodiment, the invention relates to a substrate made of PC, the surface of which is coated with an activation layer consisting of copper, the atoms of which are bonded, through metal-ligand interaction, to the constituent PC of the substrate, said activation layer being covered with a nickel layer deposited by autocatalytic deposition.

In one embodiment, the invention relates to a substrate made of PC, the surface of which is coated with an activation layer consisting of nickel, the atoms of which are bonded, through metal-ligand interaction, to the constituent PC of the substrate, said activation layer being covered with a nickel layer deposited by autocatalytic deposition.

In one embodiment, the invention relates to a substrate made of MABS, the surface of which is coated with an activation layer consisting of copper, the atoms of which are bonded, through metal-ligand interaction, to the constituent MABS of the substrate, said activation layer being covered with a nickel layer deposited by autocatalytic deposition.

In one embodiment, the invention relates to a substrate made of MABS, the surface of which is coated with an activation layer consisting of nickel, the atoms of which are bonded, through metal-ligand interaction, to the constituent MABS of the substrate, said activation layer being covered with a nickel layer deposited by autocatalytic deposition.

In one embodiment, the invention relates to a substrate made of PP, the surface of which is coated with an activation layer consisting of copper, the atoms of which are bonded, through metal-ligand interaction, to the constituent PP of the substrate, said activation layer being covered with a nickel layer deposited by autocatalytic deposition.

In one embodiment, the invention relates to a substrate made of PP, the surface of which is coated with an activation layer consisting of nickel, the atoms of which are bonded, through metal-ligand interaction, to the constituent PP of the substrate, said activation layer being covered with a nickel layer deposited by autocatalytic deposition.

In one embodiment, the invention relates to a substrate made of PPS, the surface of which is coated with an activation layer consisting of copper, the atoms of which are bonded, through metal-ligand interaction, to the constituent PPS of the substrate, said activation layer being covered with a nickel layer deposited by autocatalytic deposition.

In one embodiment, the invention relates to a substrate made of PPS, the surface of which is coated with an activation layer consisting of nickel, the atoms of which are bonded, through metal-ligand interaction, to the constituent PPS of the substrate, said activation layer being covered with a nickel layer deposited by autocatalytic deposition.

The invention also relates to a process according to the invention that further comprises a metallization step.

In one embodiment, the metallization treatment is an electroplating treatment.

The invention and its embodiments are illustrated in the following examples.

EXAMPLE 1

I. Coating of acrylonitrile-butadiene-styrene (ABS) and acrylonitrile-butadiene-styrene/polycarbonate (ABS/PC) Sheets with a Copper Layer This process for coating a substrate made of nonmetallic material with a copper layer was carried out in 4 steps (chemical oxidizing treatment using nitric acid/chelation and/or complexation/reduction/electroless bath).

I.1. Chemical Oxidizing Treatment Using Nitric Acid

Pure nitric acid was heated to 50° C. The acrylonitrile-butadiene-styrene (ABS) and acrylonitrile-butadiene-styrene/polycarbonate (ABS/PC) sheets were immersed for 8 minutes in this solution. The sheets were then rinsed twice in a water bath (1 liter).

I.2. Chelation and/or Complexation of Copper Ions

Copper sulfate (23.7 g) was solubilized in a solution of water (1000 ml) and ammonium hydroxide (30 ml). The parts that underwent the chemical oxidizing treatment of step I.1 were immersed in this bath for 15 minutes. The ABS parts were then rinsed in a 0.2M sodium hydroxide solution.

I.3. Reducing Treatment of Copper Ions

Sodium borohydride $NaBH_4$ (0.316 g, $0.8\times10^{-2}$ mol) was dissolved in 25 ml of a 0.1M sodium hydroxide (NaOH) solution. This solution was heated to 80° C. using a water bath and the specimens were immersed therein. After 12 minutes, the specimens were rinsed with MilliQ water before being dried.

I.4. Electroless Copper Bath (MacDermid M Copper® Solution)

A solution containing 100 ml of the M Copper® 85 B solution was prepared. Next, 40 ml of the M Copper® 85 A solution, then 30 ml of the M Copper® 85 D solution, then 2 ml of the M Copper® 85 G solution and finally 5 ml of 37% formaldehyde were added. The level of the solution is topped up to reach 1 liter of solution. The bath was heated to 60° C. with mechanical stirring. The ABS sheets were then introduced.

The parts were covered with the chemical copper metal film after 3 minutes of immersion.

The copper layer was visible to the naked eye.

I.5. Electroless Copper Bath

In an alternative embodiment, the electroless bath was a prepared solution containing: 40 ml of the PegCopper 100 solution, 100 ml of the PegCopper 200 solution, 30 ml of PegCopper 400 and 2 ml of PegCopper 500 (products supplied by the company Pegastech). Next, 3.5 ml of PegCopper 600 were added. The level was topped up with water in order to obtain 1 liter and the mixture was heated to 50° C. with bubbling. The parts to be treated were than introduced.

The parts were covered with the chemical copper metal film after 3 minutes of immersion.

The copper layer was visible to the naked eye.

EXAMPLE 2

II. Coating of a Polyamide Substrate with a Copper Layer

The coating process was carried out with a substrate made of Minion® polyamide.

II.1. Chemical Oxidizing Treatment Using Hydrochloric Acid and Isopropanol

The polyamide substrate was immersed in an aqueous solution containing 130 ml of water, 28 ml of hydrochloric acid (37M) and 55 ml of isopropanol at 28° C. for 17 minutes. The substrate was then rinsed with water.

II.2. Chelation and/or Complexation of the Copper Ions

According to a process similar to that of step I.2 in example 1, copper ions were chelated to the surface of the substrate.

II.3. Reduction Treatment of the Copper Ions

According to the operating method described in I.3, the chelated copper ions were reduced at the surface of the substrate.

II.4. Electroless Copper Bath

According to a process similar to that of step I.4 or I.5 described in example 1, the polyamide substrate was covered with a chemical copper metal film.

The copper layer was visible to the naked eye.

EXAMPLE 3

III. Coating of a Polycarbonate Substrate with a Copper Layer

The coating process was carried out with a Lexan® polycarbonate substrate.

III.1. Chemical Oxidizing Treatment with Strong Acids

The polycarbonate substrate was immersed in a solution containing a mixture of strong acids (34% nitric acid and 66% sulfuric acid) at 25° C. for 5 minutes, and then in a concentrated sulfuric acid bath at 25° C. for 3 minutes. The whole assembly was neutralized in a 5N potassium hydroxide solution at 65° C. for 5 minutes. The polycarbonate substrate was then rinsed with water.

III.2. Chelation and/or Complexation of the Copper Ions

According to a process similar to that of step I.2 described in example 1, copper ions were chelated to the surface of the substrate.

III.3. Reduction Treatment of the Copper Ions

According to the operating method described in I.3, the chelated copper ions were reduced at the surface of the substrate.

III.4. Electroless Copper Bath

According to a process similar to that in step I.4 or I.5 described in example 1, the polycarbonate substrate was covered with a chemical copper metal film.

The copper layer was visible to the naked eye.

EXAMPLE 4

Adhesion tests according to the NF ISO 2409/NF T30-038 standard and corrosion tests according to the DIN ISO 9227 standard were carried out on the substrates obtained in examples 1 to 3, and the performance complied with the requirements of these tests and was comparable to the performance achieved with substrates obtained according to the processes of the prior art.

The invention claimed is:

1. A process for coating a surface of a substrate made of nonmetallic material with a metal layer, characterized in that it consists of the following steps:

a. providing a substrate made of nonmetallic material;

b. subjecting at least part of at least one surface of said substrate to a physical or chemical treatment for increasing the specific surface area thereof;

c. subjecting the surface of said substrate that was treated in step b) to an oxidizing treatment, or alternatively, performing steps b) and c) in a single step b') that is an oxidizing treatment;

d. bringing the surface of said substrate that was treated in step c) or b') into contact with a solution containing at least one ion of at least one metal and its counterion, said metal being chosen from the group constituted of the metals of groups IB and VIII of the Periodic Table of the Elements, and the solution being a basic solution;

e. obtaining a substrate comprising ions of at least one metal that are chemically attached to the nonmetallic material constituting the substrate on at least one part of at least one of its surfaces;

f. subjecting said ions of at least one metal that are chemically attached to the nonmetallic material constituting the substrate on a surface of said substrate to a reducing treatment and obtaining a substrate comprising atoms of at least one metal that are chemically attached to the nonmetallic material constituting the substrate on at least one part of at least one of its surfaces;

g. bringing the surface comprising particles of at least one metal which was obtained in step f) into contact with a solution containing ions of at least one metal, or alternatively, carrying out steps f) and g) as a single step f');

h. obtaining a coating formed by a layer of at least one metal on the treated surface of said substrate, said steps being optionally followed or preceded by one or more rinsing steps.

2. The process as claimed in claim 1, wherein steps b) and c) are carried out as a single step b') and the treatment is an oxidizing treatment.

3. The process as claimed in claim 1, wherein the metal of step f) and the metal of the ions of step g) are identical.

4. The process as claimed in claim 1, wherein steps f) and g) are carried out as a single step f').

5. The process as claimed in claim 4, wherein the solution of step f') comprises ions of the metal, a complexing agent that complexes the ions of the metal, a reducing agent and a pH regulator.

6. The process as claimed in claim 1, wherein step b) is implemented by a physical treatment.

7. The process as claimed in claim 6, wherein the physical treatment is chosen from the group of impact treatments.

8. The process as claimed in claim 1, wherein step b) or b') or c) is implemented by an oxidizing treatment.

9. The process as claimed in claim 1, wherein the oxidizing treatment is chosen from the group of chemical oxidizing treatments.

10. The process as claimed in claim 9, wherein the chemical oxidizing treatment is chosen from the group constituted of Fenton's reagent, alcoholic potassium hydroxide, a strong acid, sodium hydroxide, a strong oxidizing agent and ozone, by themselves or in combinations.

11. The process as claimed in claim 10, wherein the strong acid is chosen from the group constituted of hydrochloric acid, sulfuric acid, nitric acid, perchloric acid, phosphorous acid, phosphoric acid, hypophosphorous acid, oxalic acid and acetic acid, by themselves or as a mixture.

12. The process as claimed in claim 10, wherein the strong oxidizing agent is chosen from the group constituted of $KMnO_4$ and $KClO_3$, by themselves or as a mixture.

13. The process as claimed in claim 9, wherein the chemical oxidizing treatment is an electrochemical treatment.

14. The process as claimed in claim 1, wherein the metal of the metal ion used in step d) is chosen from copper, silver, nickel, platinum, palladium and cobalt ions.

15. The process as claimed in claim 1, wherein the metal of the metal ion used in step d) is chosen from the group constituted of copper and nickel.

16. The process as claimed in claim 1, wherein the reducing solution comprises a reducing agent chosen from the group constituted of sodium borohydride, dimethylamine borane and hydrazine solutions.

17. The process as claimed in claim 1, wherein, prior to and between each step of the process, the surface of the substrate and/or the substrate are/is rinsed one or more times with at least one rinsing solution.

18. The process as claimed in claim 17, wherein the rinsing solution is stirred during contacting with the surface of the substrate and/or the substrate.

19. The process as claimed in claim 1, which further comprises a metallization step.

20. The process as claimed in claim 19, wherein the metallization step is an electroplating treatment step.

* * * * *